US007225566B1

(12) United States Patent
Kimble

(10) Patent No.: US 7,225,566 B1
(45) Date of Patent: Jun. 5, 2007

(54) HYBRID MALE COUPLER PORTION FOR A FRONT-END LOADER

(75) Inventor: Allen E. Kimble, Rock Spring, GA (US)

(73) Assignee: JRB Attachments, LLC, Cedar Rapids, IA (US)

( * ) Notice: Subject to any disclaimer, the term of this patent is extended or adjusted under 35 U.S.C. 154(b) by 188 days.

(21) Appl. No.: 10/821,351

(22) Filed: Apr. 9, 2004

Related U.S. Application Data

(60) Provisional application No. 60/461,550, filed on Apr. 9, 2003.

(51) Int. Cl.
*E02F 3/96* (2006.01)

(52) U.S. Cl. ..... 37/468; 37/403; 414/723

(58) Field of Classification Search ..... 37/468, 37/403; 172/683, 275, 272; 414/686, 723, 414/724; 403/24, 322
See application file for complete search history.

(56) References Cited

U.S. PATENT DOCUMENTS 4,243,356 A * 1/1981 Takojima ..... 414/723
4,708,579 A 11/1987 Baird et al.
4,812,103 A * 3/1989 Cochran et al. ..... 414/723
4,963,071 A * 10/1990 Larwin et al. ..... 414/723
5,310,275 A * 5/1994 Lovitt ..... 403/322.3
5,415,235 A 5/1995 Gebauer
5,529,419 A 6/1996 Gebauer
5,692,850 A 12/1997 Kimble et al.
5,732,488 A * 3/1998 Smith ..... 37/468
5,820,332 A * 10/1998 Philips et al. ..... 414/723
6,196,595 B1 * 3/2001 Sonerud ..... 285/26
6,227,792 B1 5/2001 Baker et al.
6,386,822 B1 * 5/2002 Burr ..... 414/723

* cited by examiner

*Primary Examiner*—Thomas A Beach
(74) *Attorney, Agent, or Firm*—Fay Sharpe LLP

(57) ABSTRACT

A hybrid male coupler portion for a front-end loader mates selectively and interchangeably with first and second different female coupler portions. The coupler portion includes a frame. The frame includes: (i) first and second arm pin-on locations adapted for connection to associated first and second arms, respectively; (ii) at least one tilt member pin-on location adapted for connection to an associated tilt member; and (iii) first and second coupler halves. Each of the first and second coupler halves includes: a first hook-engaging mount; a first rib locking location aligned with the first hook-engaging mount; a second hook-engaging mount; a second rib locking location aligned with the second hook-engaging mount; and, a plunger pin slidably connected to the frame and movable between an extended position and a retracted position. The plunger pin, when extended, is adapted to engage and retain an associated female coupler portion rib ear located in one of the first and second rib locking locations.

6 Claims, 8 Drawing Sheets

HYBRID MALE COUPLER PORTION FOR A FRONT-END LOADER

CROSS-REFERENCE TO RELATED APPLICATION

This application claims priority from and benefit of the filing date of U.S. provisional patent application Ser. No. 60/461,550 filed Apr. 9, 2003.

BACKGROUND OF THE INVENTION

Couplers and coupling systems for front-end loaders are well-known and widely used to provide for quick connect/disconnect of attachments, such as buckets, forks or the like, to the arms and tilt control linkage of a front-end loader or like machine. As used herein, the term "front-end loader" is intended to encompass front-end loaders and all other tractors and machines including two laterally spaced-apart arms and one or more tilt control cylinders, links, or the like that control the angular position of a male coupler portion and/or an attachment pivotally secured to the arms. Examples of known couplers and coupling systems of the general type disclosed herein can be found in commonly owned U.S. Pat. Nos. 4,708,579; 5,415,235; 5,529,419; and 5,692,850, the disclosures of which are hereby expressly incorporated by reference herein.

As is widely known in connection with loader coupling systems, a male coupler portion is operatively connected to the arms and control linkage of a front-end loader machine. The female coupler portion is defined by two parallel, spaced-apart ribs that are welded to otherwise fixedly secured to a bucket or other attachment such as forks or the like. Thus, the front-end loader is able to couple with any desired attachment by mating the male coupler portion to the female coupler portion of a desired attachment for use of the attachment.

FIG. 1A illustrates a first type of conventional female rib FR1. As is known in the art and as shown in FIG. 1C, two of the ribs FR1 are welded or otherwise fixedly secured vertically to a bucket or other attachment AT in parallel, spaced-apart relation to define a first type of female coupler portion B. Each rib FR1 comprises a hook portion FH1 and an ear portion FT1 spaced from the hook portion, but lying in the same plane therewith. The ear portion FT1 includes a lock aperture FA1 that extends transversely therethrough. In use, the hook portion FH1 is adapted to receive a mounting pin or other mounting member of a male coupler portion. The hook portion FH1 and mounting member of the male coupler portion typically comprise mating cylindrical surfaces. When the hook portion FH1 is seated on the mounting pin/member of the male coupler portion, the ear portion FT1 of the rib moves into a locking region of the male coupler portion where it is engaged by a lock mechanism to secure the rib FR1 to the male coupler portion in a releasable fashion. Typically, the lock mechanism comprises a plunger pin that is slidably received in the lock aperture FA1 of the ear FT1 so as to prevent withdrawal of the ear from the locking region of the male coupler portion which, in turn, prevents separation of the hook portion FH1 from the mounting pin/member that is seated therein. As noted, in practice, first and second ribs FR1 are used to define a female coupler portion B and, thus, the mating male coupler portion includes respective first and second mounting locations, and first and second lock mechanisms, to secure the ribs to the male coupler portion. The female rib FR1 shown in FIG. 1A is commonly referred to as a JRB-style rib in that two of the ribs FR1 arranged in an appropriate manner define a female coupler portion that is engageable by a male coupler portion available commercially from JRB Company, Inc., Akron, Ohio, U.S.A.

FIG. 1B partially illustrates a second type of conventional female rib FR2. As is known in the art, two vertical ribs FR2 are welded or otherwise fixedly secured to a bucket or other attachment in parallel, spaced-apart relation to define a second type of female coupler portion in the same arrangement as shown for the female coupler portion B in FIG. 1C. The rib FR2 functions similarly to the rib FR1 but is shaped, and dimensioned differently, and the ribs FR2 are spaced differently relative to each other laterally to define a female coupler portion as compared to the ribs FR1. Each rib FR2 comprises a hook portion FH2 and an ear portion FT2 spaced from the hook portion but in the same plane therewith. The ear portion FT2 includes a transverse lock aperture FA2 that extends therethrough. In use, the hook portion FH2 is adapted to receive a mounting pin or other mounting member of a male coupler portion. The hook portion FH2 and mounting member of the male coupler portion typically comprise mating cylindrical surfaces. When the hook portion FH2 is seated on the mounting pin/member of the male coupler portion, the ear portion FT2 moves into a locking region of the male coupler portion where it is engaged by a lock mechanism to secure the rib FR2 to the male coupler portion. Here, again, the lock mechanism of the male coupler portion typically comprises a plunger pin that is slidably received in the lock aperture FA2 of the tongue FT2 so as to prevent withdrawal of the ear FT2 from the locking region of the male coupler portion which, in turn, prevents separation of the hook portion FH2 from the mounting pin/member that is seated therein. As noted, in practice, first and second ribs FR2 are used to define a female coupler portion and, thus, the mating male coupler portion includes first and second mounting members, and first and second lock mechanisms, to secure the ribs to the male coupler portion. The female rib FR2 shown in FIG. 1B is commonly referred to as a CAT-style rib in that two of the ribs FR2 arranged in an appropriate manner define a female coupler portion that is engageable by a male coupler portion available commercially from Caterpillar Inc., Peoria, Ill., U.S.A.

A problem arises with known male coupler portions in that they have heretofore been dedicated to a particular type of female coupler portion. As such, known male coupler portions can only be used to pick-up attachments having the required female rib arrangement. In the field or as part of an equipment rental fleet operation, this limits the use of a particular front-end loader and/or requires the male coupler portion to be changed at the pin-on connection which is highly undesirable.

According to the present invention, a hybrid male coupler portion for a front-end loader is provided and operable to mate selectively and interchangeably with first and second different female coupler portions.

SUMMARY

In accordance with a first aspect of the present invention, a male coupler portion includes a frame. The frame includes: (i) first and second arm pin-on locations adapted for connection to associated first and second arms, respectively; (ii) at least one tilt member pin-on location adapted for connection to an associated tilt member; and (iii) first and second coupler halves. Each of the first and second coupler halves includes: a first hook-engaging mount; a first rib locking location aligned with the first hook-engaging mount; a second hook-engaging mount; a second rib locking location aligned with the second hook-engaging mount; and, a plunger pin slidably connected to the frame and movable between an extended position and a retracted position. The plunger pin, when extended, is adapted to engage and retain an associated female coupler portion rib ear located in one of the first and second rib locking locations.

In accordance with another aspect of the invention, a male coupler portion comprises a first pair of mounts adapted for respective engagement with a first pair of ribs of a first associated female coupler portion configuration, and a second pair of mounts adapted for respective engagement with a second pair of ribs of a second associated female coupler portion configuration. First and second rib locking pins each move between a retracted position and an extended position.

DETAILED DESCRIPTION OF PREFERRED EMBODIMENTS

Figure 1A:
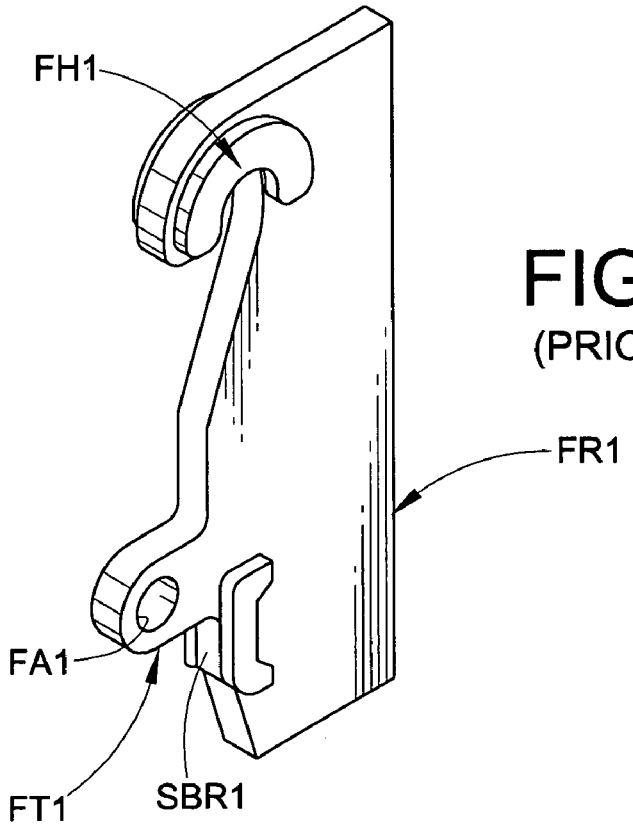
FIG. 1A (PRIOR ART)
FIG. 1A (prior art) is an isometric illustration of a first type of conventional female rib, two of which are used to define a first female coupler portion.
Figure 1B:
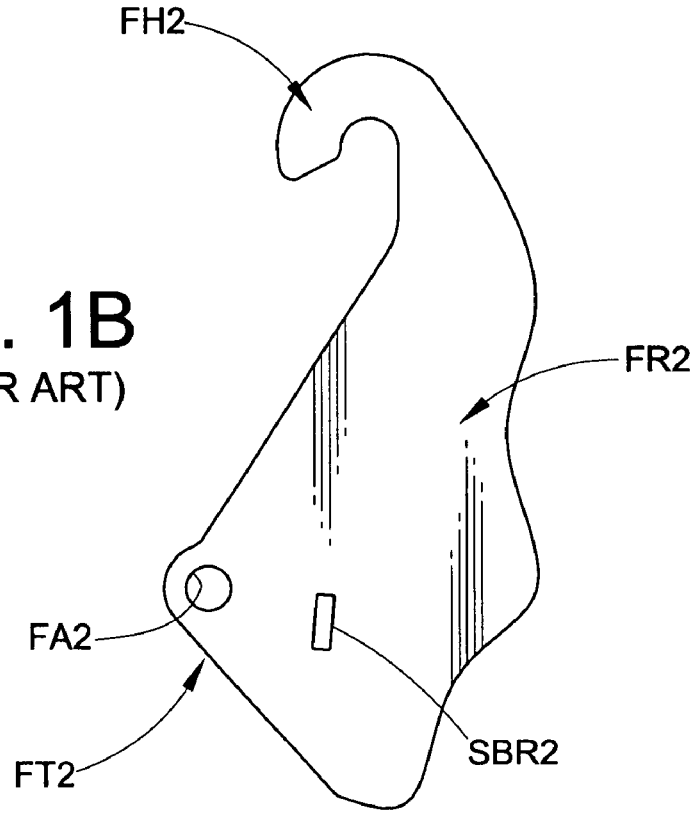
FIG. 1B (PRIOR ART)
FIG. 1B (prior art) is a partial side elevational view of a second type of conventional female rib, two of which are used to define a second female coupler portion.
Figure 1C:
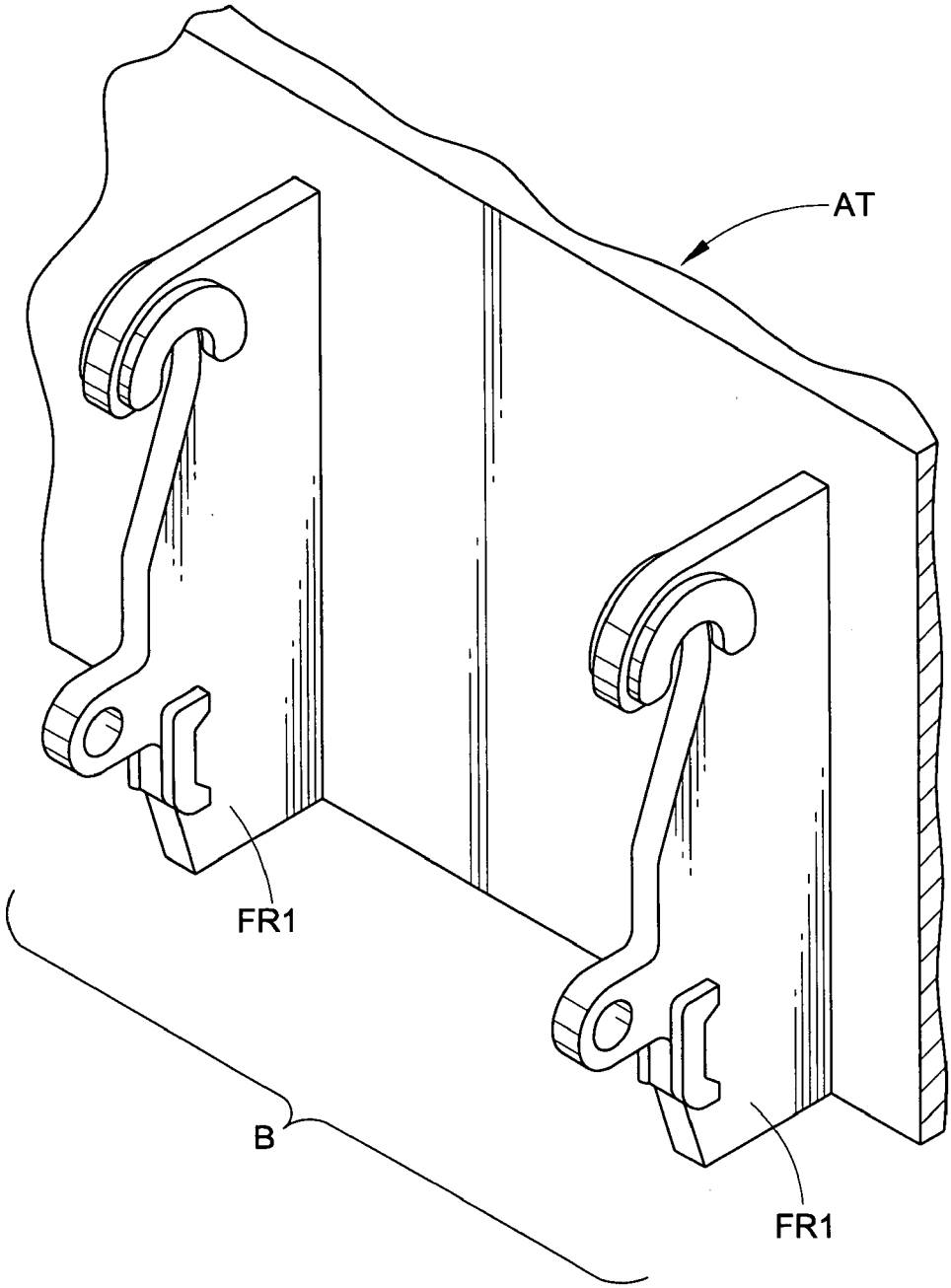
FIG. 1C (PRIOR ART)
FIG. 1C (prior art) illustrates a conventional female coupler portion defined by two of the ribs shown in FIG. 1A.
Figure 2:
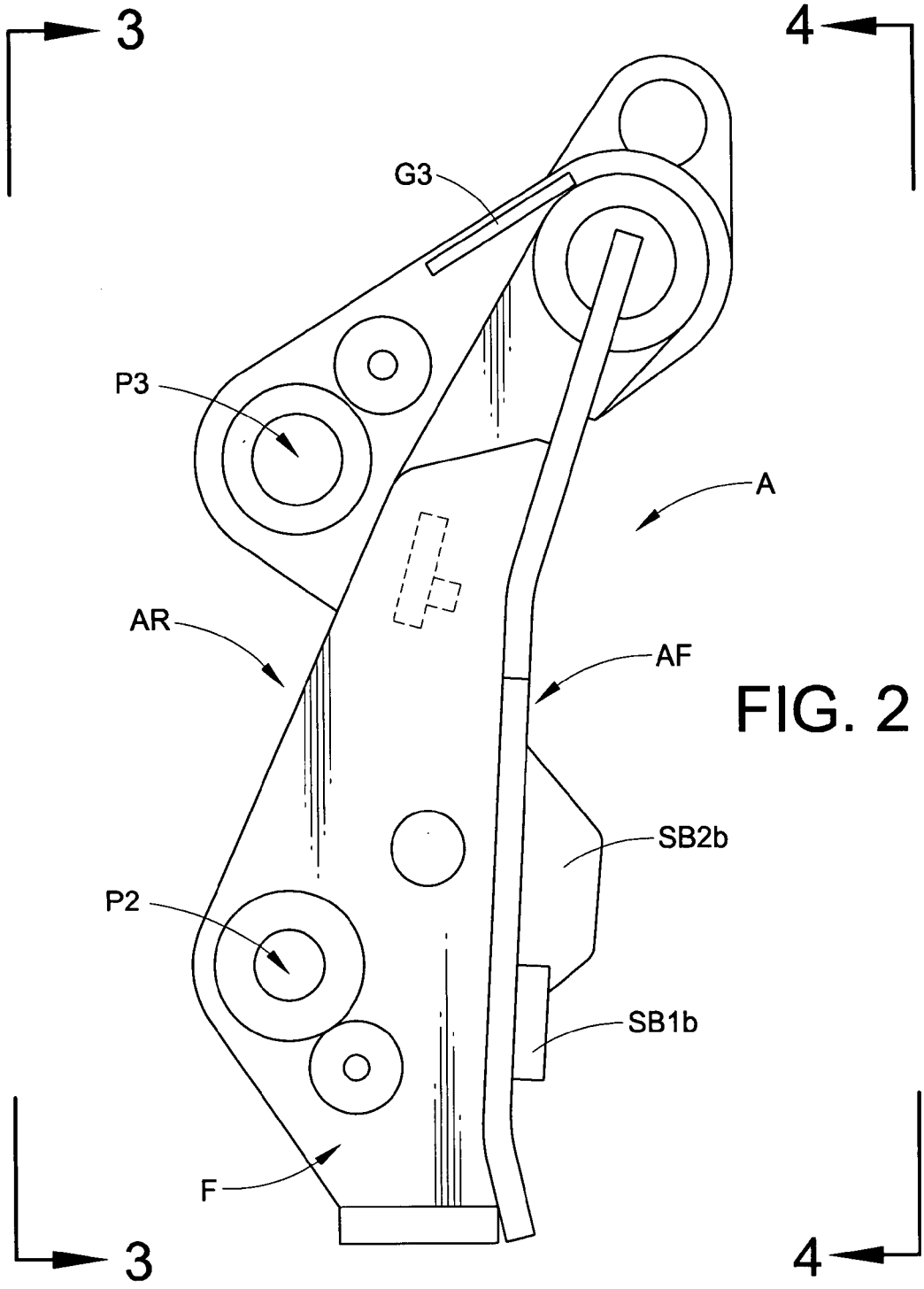
FIG. 2 is a right side elevational view of a hybrid male coupler portion formed in accordance with the present invention.
Figure 3:
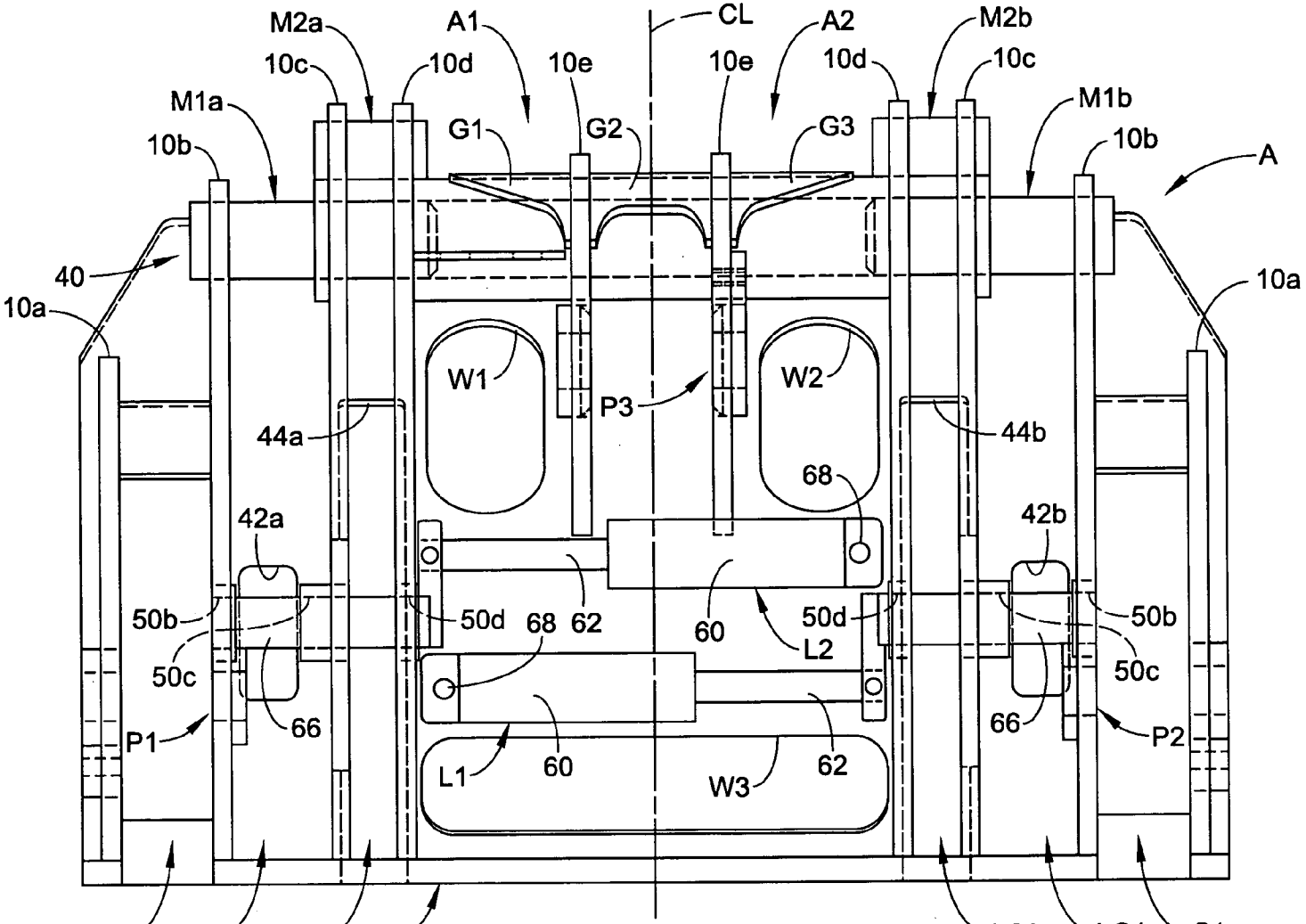
FIG. 3 is a rear elevational view of the hybrid male coupler portion as taken along line 3—3 of FIG. 2.
Figure 4:
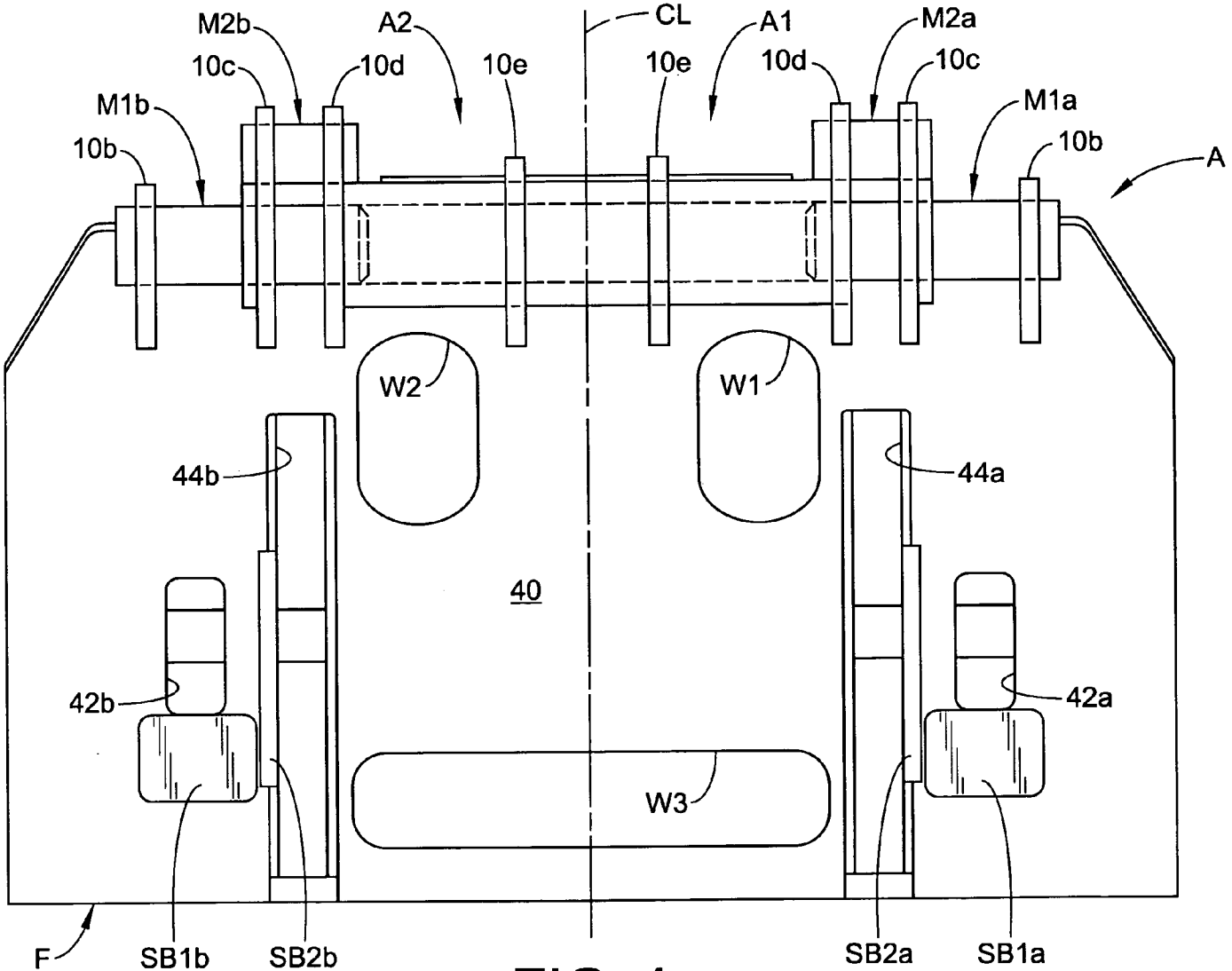
FIG. 4 is a front elevational view of the male coupler portion as taken along line 4—4 of FIG. 2 (with the lock plungers retracted as compared to FIG. 3); and, FIGS. 5 and 6 are rear isometric and rear elevational views of the male coupler portion shown in FIG. 2, with the lock assemblies removed for clarity.

FIGS. 2–4 illustrate a male coupler portion A comprising a welded steel frame F and first and second lock assemblies L1,L2 (FIG. 3). The coupler A is defined by first and second lateral halves A1,A2 that are formed substantially symmetrical about a centerline CL, except for the location of the lock assemblies L1,L2. For ease of understanding the development, the male coupler portion A is described herein as having a front region AF (FIG. 2) that is oriented toward and engages an associated female coupler portion B (defined by two ribs FR1 or two ribs FR2 as described above), and a rear region AR that is oriented toward and connected via pin-on connection to an associated loader machine (not shown).

Figure 5:
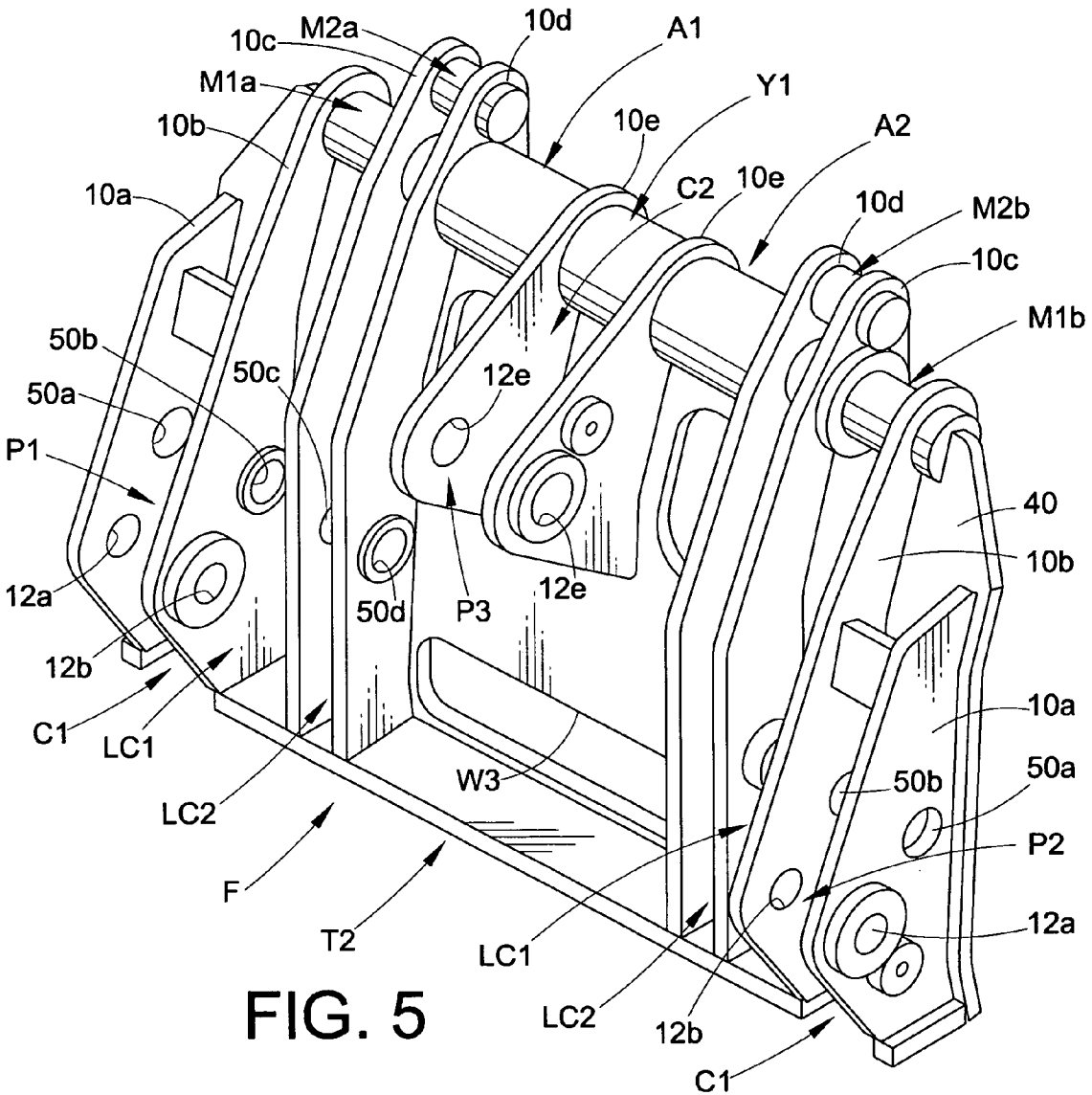
Figure 6:
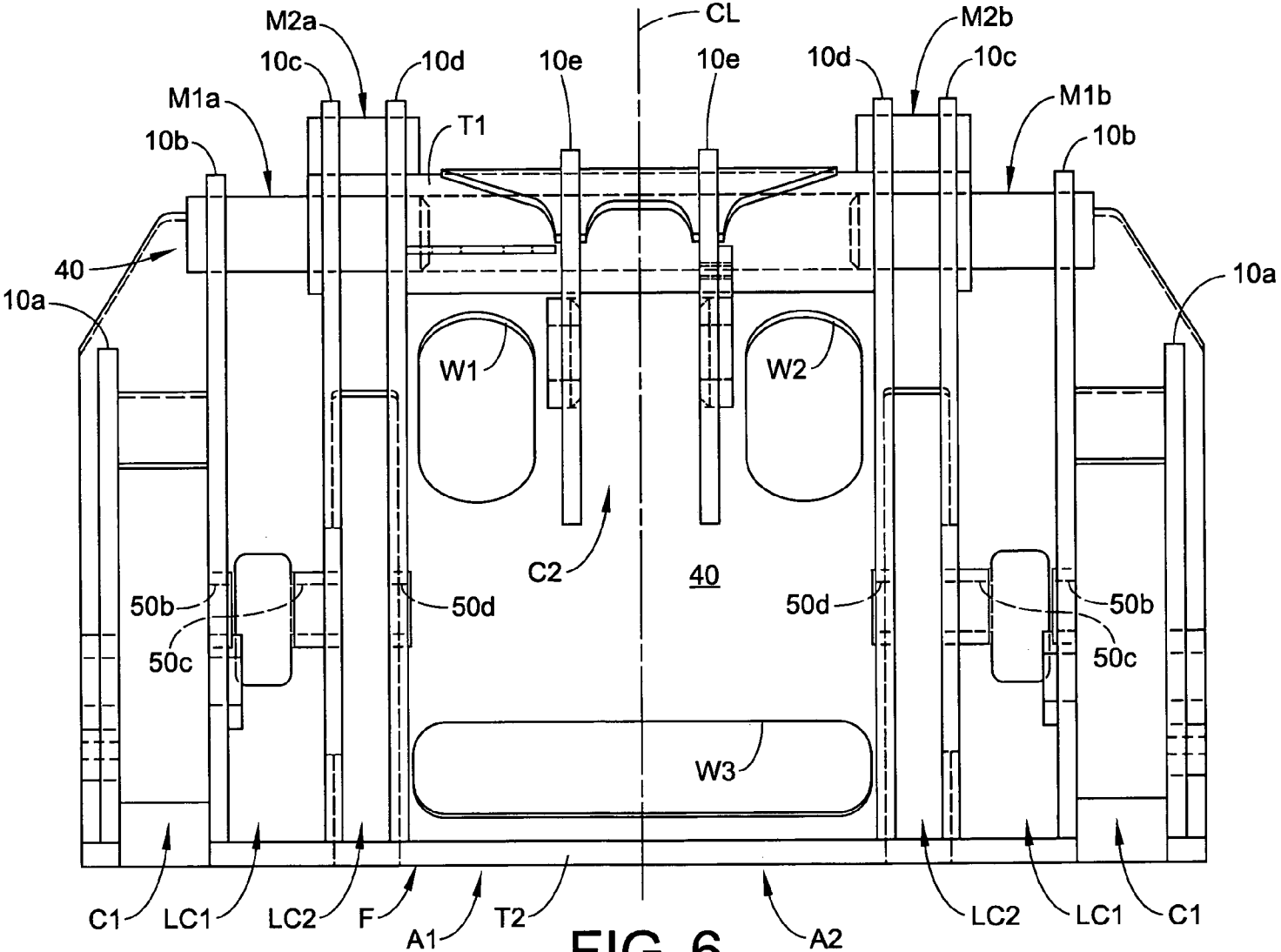

With reference also now FIGS. 5 and 6, the frame F comprises a plurality of parallel, spaced-apart vertical ribs defined from steel plate or the like. In the illustrated embodiment, each half A1,A2 of the male coupler portion A comprises five parallel vertical ribs 10*a*,10*b*,10*c*,10*d*,10*e*. The ribs 10*a*,10*b* of each coupler half A1,A2 cooperate to define therebetween an arm-receiving channel C1 adapted to receive the distal end of the arm of an associated loader machine. The ribs 10*a*,10*b* define respective apertures 12*a*, 12*b* that are aligned so as to define an arm pin-on points P1 (for the coupler half A1) and P2 (for the coupler half A2). As such, the ribs 10*a*,10*b* of each coupler half A1,A2 are adapted for pin-on pivotable connection to associated parallel arms of a wheel loader at locations P1,P2 by means of the aligned apertures 12*a*,12*b*. This allows the male coupler portion A to pivot relative to the loader arms about the pin-on points P1,P2 between dump and roll-back positions known in the art.

The male coupler portion A is also configured for operative connection to one or more tilt control links/members such as linkages, cylinder rod-eyes or the like. As shown, the associated tilt link or other tilt control member of the associated wheel loader is adapted for a pivoting pin-on connection to the male coupler portion A between the central ribs 10*e* of each coupler half A1,A2 at a location P3 by means of aligned apertures 12*e* defined in the central ribs 10*e*. More particularly, the two central ribs 10*e* cooperate to define therebetween a link channel C2 adapted to receive an associated tilt link, cylinder rod eye or other member that controls the angular position of the male coupler portion A relative to the loader arms connected at points P1,P2. The tilt link or other control member is pivotally secured to the male coupler portion A via pin-on connection at the point P3 defined by the aligned apertures 12*e* of ribs 10*e*. Bosses and pin-retainers are provided at all pin-on locations P1,P2,P3 to ensure proper pin fit and retention and for added strength as is generally known in the art.

Each coupler half A1,A2 comprises first and second rib locking locations aligned respectively with the first and second hook-engaging mounts M1*a*,M2*a* (for the coupler half A1) and M1*b*,M2*b* (for the coupler half A2). In the illustrated embodiment, the ribs 10*b*,10*c* of each coupler half A1,A2 define therebetween a first lock channel LC1 to provide the first rib locking location, and the ribs 10*c*,10*d* of each coupler half define therebetween a second lock channel LC2 to provide the second rib locking location. With reference to FIGS. 5 and 6, it can be seen that the ribs 10*b*,10*c*, 10*d* of each coupler half A1,A2 define respective lock apertures 50*b*,50*c*,50*d* that are aligned with each other (the ribs 10*a* also define apertures 50*a* that are aligned with the lock apertures 50*b*,50*c*,50*d*, but the apertures 50*a* are used only to provide machining access for the lock apertures 50*b*,50*c*,50*d*). The first and second lock channels LC1,LC2 are only one example of first and second rib locking locations. In another embodiment, for example, a single channel or other space provides both the first and second rib locking locations.

The ribs 10*b*,10*c*,10*d*,10*e* of each coupler half A1,A2 are fixedly secured to a first, upper round (or other shape) steel cross-bar/cross-member T1 by insertion of the member T1 through aligned apertures defined in the ribs 10*b*,10*c*,10*d*, 10*e* of each half A1,A2 and welding at the juncture of the member T1 with each of the ribs. A lower cross-bar/cross-member T2 is spaced vertically from the upper cross member T1. The lower cross-bar T2 is welded to the ribs 10*b*,10*c*,10*d*. In the illustrated embodiment, the lower cross-bar T2 is welded to the lowermost edge of each rib so that the cross-bar T2 defines a continuous lower skid plate for the frame F. Various gussets G1,G2,G3 are provided for added strength (shown only in FIGS. 2, 3 and 6). The cross-members T1,T2 are preferably arranged parallel to each other and perpendicular to ribs 10*a*–10*e*.

With continuing reference to FIGS. 4–6, the male coupler portion A comprises a pair of first hook engaging mounts M1*a*,M1*b* and a pair of second hook engaging mounts M2*a*,M2*b*. More particularly, each pair of mounts M1*a*,M1*b* and M2*a*,M2*b* is split between the coupler halves A1,A2 so that the coupler half A1 comprises the mounts M1*a*,M2*a* and the coupler half A2 comprises the mounts M1*b*,M2*b*, with the mounts M1*a*,M1*b* coaxially aligned with each other and the mounts M2*a*,M2*b* coaxially aligned with each other.

The first mounts M1*a*,M1*b* are adapted to be received into and engaged by the hooks FH1 of a first female coupler portion B defined by two of the first ribs FR1. Likewise, the second mounts M2*a*,M2*b* are adapted to be received into and engaged by the hooks FH2 of a second female coupler portion defined by two of the second ribs FR2.

More particularly, in the illustrated embodiment, each of the first mounts M1*a*,M1*b* comprises a round steel member inserted into an open end of the upper cross-member T1 and welded thereto. Alternatively, the mounts M1*a*,M2*a* can be defined as a one-piece construction with cross-member T1. The second mounts M2*a*,M2*b* each comprise a round steel member inserted through aligned apertures in and welded to the ribs 10*c*,10*d* of each half A1,A2 of the coupler frame F. The mounts M1*a*,M1*b* and M2*a*,M2*b* can be provided in other arrangements and it is not intended that the invention be limited to the embodiment disclosed herein. For example, the mounts M1*a*,M1*b* need not be connected to or defined as a part of the cross-member T1 and, alternatively, can be provided separate from the upper cross-member T1. The mounts M2*a*,M2*b* can also be connected to or defined as a part of the cross-member T1. In every case, however, it is preferred that the mounts M1*a*,M1*b* each comprise a cylindrical surface that mates with a cylindrical surface of the hooks FH1 of the ribs FR1, and that the mounts M2*a*,M2*b* each comprise a cylindrical surface that mates with a cylindrical surface of the hooks FH2 of the ribs FR2. In this manner, the ribs FR1 can rotate about the mounts M1*a*,M1*b* and the ribs FR2 can rotate about the mounts M2*a*,M2*b* during coupling with and decoupling from an associated female coupler portion.

It should be noted that the first mounts M1*a*,M1*b* are located between the ribs 10*b*,10*c* of each coupler half A1,A2 so as to be aligned with the first lock channel LC1. Correspondingly, the second mounts M2*a*,M2*b* are located between the ribs 10*c*,10*d* of each coupler half A1,A2 so as to be aligned with the second lock channel LC2.

With continuing reference to FIGS. 4 and 5, a steel face plate 40 extends across the front AF of the coupler A. The steel face plate 40 is welded to all of the ribs 10*a*,10*b*,10*c*, 10*d*,10*e* of both coupler halves A1,A2. It is most preferred that, for added visibility, the plate 40 define at least one and preferably a plurality of openings or windows W1,W2,W3 through which an operator can visualize the female coupler portion to be engaged by the coupler A. The plate 40 is preferably a one-piece construction, but can be defined by separate plates connected to the ribs 10*a*–10*e*.

As best seen in FIG. 4, the plate 40 defines a first pair of openings 42*a*,42*b* through which ears FT1 of ribs FR1 project when the male coupler portion A is mated to a female coupler portion B defined by two ribs FR1, i.e., when the mounts M1*a*,M1*b* of male coupler portion A are fully seated in the hooks FH1 of the two ribs FR1 defining the female coupler portion. More particularly, the opening 42*a* is aligned with the mount M1*a* and lock channel LC1 of the coupler half A1, and the opening 42*b* is aligned with the mount M1*b* and lock channel LC1 of the coupler half A2. As such, when a female coupler portion B defined by two ribs FR1 is operably mated with the male coupler portion A (when the mounts M1*a*,M1*b* are fully received in the hooks FH1 of the ribs FR1), one of the ears FT1 projects through plate 40 via opening 42*a* into the lock channel LC1 of coupler half A1, and the other ear FT1 projects through plate 40 via opening 42*b* into the lock channel LC1 of coupler half A2.

Similarly, with continuing reference to FIG. 4, the plate 40 defines a second pair of openings 44*a*,44*b* through which the tongues FT2 and other portions of ribs FR2 project when the male coupler portion A is mated to a female coupler portion defined by two ribs FR2, i.e., when the mounts M2*a*,M2*b* of male coupler portion A are fully seated in the hooks FH2 of the two ribs FR2 defining the female coupler portion. More particularly, the opening 44*a* is aligned with the mount M2*a* and lock channel LC2 of the coupler half A1, and the opening 44*b* is aligned with the mount M2*b* and lock channel LC2 of the coupler half A2. As such, when a female coupler defined by two ribs FR2 is operably mated with the male coupler portion A (when the mounts M2*a*,M2*b* are fully received in the hooks FH2 of the ribs FR2), one of the tongues FT2 projects through plate 40 via opening 44*a* into the lock channel LC2 of coupler half A1, and the other tongue FT2 projects through plate 40 via opening 44*b* into the lock channel LC2 of coupler half A2.

Figure 3A:
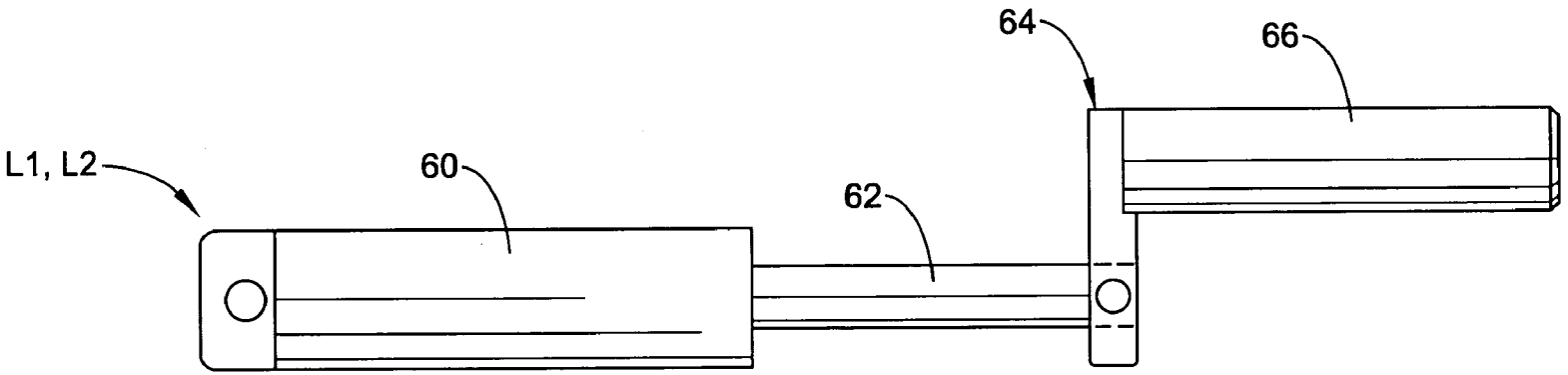
FIG. 3A illustrates a lock assembly of the male coupler portion.

As briefly noted above, the coupler A comprises first and second lock assemblies L1,L2 as shown in FIG. 3. With brief reference to FIG. 3A, the lock assemblies L1,L2 are preferably identical or substantially similar and comprise an actuator such as a hydraulic screw or cylinder 60 including a rod 62 that extends and retracts as is well known in the art. The lock assemblies L1,L2 each further comprise a plunger assembly 64 comprising a plunger pin 66. The plunger pin 66 is conformed and dimensioned to be closely (with minimal clearance) and slidably received into and through the aligned lock apertures 50*b*,50*c*,50*d* of the respective coupler halves A1,A2. In the illustrated embodiment, the plunger pin 66 and lock apertures 50*b*,50*c*,50*d* are cylindrical. Alternatively, the lock assemblies L1,L2 are manually operable so that the plunger pins 66 are manually moved to and between the extended and retracted positions.

As shown in FIG. 3, lock assemblies L1,L2 are mounted to a rear surface of the face plate 40 and/or to ribs 10*d*, between the ribs Mod of each coupler half A1,A2. Pins 68 or other suitable convenient means such as fasteners, welding, or the like are used to connect the lock assemblies L1,L2 to the plate 40. The lock assembly L1 is arranged so that the plunger pin 66 thereof is selectively extensible via rod 62 into and through the aligned apertures 50*b*–50*d* of coupler half A1 to provide a "locked" position. Retraction of the rod 62 results in the pin 66 of lock assembly L1 being withdrawn from lock channels LC1,LC2 of coupler half A1 to provide an "unlocked" position (preferably the unlocked position is defined as the position where the plunger pin 66 does not prevent movement of rib ears FT1,FT2 into and out of respective lock channels LC1,LC2 for coupling/decoupling operations). Similarly, the lock assembly L2 is arranged so that the plunger pin 66 thereof is selectively extensible via rod 62 into and through the aligned apertures 50*b*–50*d* of coupler half A2 to provide a "locked" position. Retraction of the rod 62 results in withdrawal of pin 66 from the lock channels LC1,LC2 of the coupler half A2 to provide an "unlocked" position (preferably the unlocked position is defined as the position where the plunger pin 66 does not prevent movement of rib ears FT1,FT2 into and out of respective lock channels LC1,LC2 for coupling/decoupling operations). The lock assemblies L1,L2 can alternatively be integrated into a single lock assembly comprising the two plunger pins 66 moved by one or two actuators 60. FIG. 3 shows the rods 62 of each cylinder 60 extended, so that the plunger pins 66 are in the "locked" position where they are fully inserted into and through the relevant locking apertures 50*b*–50*d*. FIG. 4 is a front view that shows the "unlocked" position for the plunger pins 66.

With the foregoing in mind, operation of the coupler A will be readily apparent to those of ordinary skill in the art. When the coupler A is mated to a female coupler portion B comprising two of the first ribs FR1, the ribs FR1 contact the face plate 40, with one of the hooks FH1 received over and engaged with the first mount M1*a* and the other of the hooks FH1 received over and engaged with the first mount M1*b*. The ears FT1 of the ribs FR1 project through the respective plate openings 42*a*,42*b* into the lock channels LC1 of the coupler halves A1,A2, respectively. In this position, the aperture FA1 of each ear FT1 is aligned with the aligned lock apertures 50*b*,50*c*,50*d*. The aperture FA1 of each tongue FT1 is also shaped and dimensioned to closely receive the plunger pin 66 of the relevant lock assembly L1,L2. As such, with the ribs FR1 so positioned, the hydraulic cylinders 60 are actuated to extend the rods 62 so that the plunger pins 66 move to the extended or "locked" position where the pin 66 of each coupler half A1,A2 is received through the relevant aligned apertures 50*b*,50*c*,50*d* and the ear aperture FT1. In this position, the ribs FR1 are operably secured to and captured on the male coupler portion A. Decoupling is accomplished with retracting both pins 66 so that the ribs FR1 can be unmated from the male coupler portion A.

The coupler A can also be mated to a female coupler portion comprising two of the second ribs FR2. In this case, the ribs FR2 contact the face plate 40, with one of the hooks FH2 received over and engaged with the second mount M2*a* and the other of the hooks FH2 received over and engaged with the second mount M2*b*. The ears FT2 of the ribs FR2 project through the respective plate openings 44*a*,44*b* into the second lock channels LC2 of the coupler halves A1,A2, respectively. In this position, the aperture FA2 of each ear FT2 is also aligned with the lock apertures 50*b*,50*c*,50*d*. The aperture FA2 of each ear FT2 is also shaped and dimensioned to closely receive the plunger pin 66 of the relevant lock assembly L1,L2. As such, with the ribs FR2 so positioned, the hydraulic cylinders 60 are actuated to extend the rods 62 so that the plunger pins 66 move to the extended or "locked" position where the pin 66 of each coupler half A1,A2 is received through the relevant aligned apertures 50*b*,50*c*,50*d* and the ear aperture FT2. In this position, the ribs FR2 are operably secured to and captured on the male coupler portion A. Decoupling is accomplished with retracting both pins 66 so that the ribs FR2 can be unmated from the male coupler portion A.

Various stop plates and the like are preferably connected to the face plate 40 to abut with stop surfaces of the ribs FR1,FP2 to ensure that the ribs are properly positioned when the male coupler portion A is mated therewith. More particularly, the male coupler portion comprises a first pair of stop blocks SB1*a*,SB1*b* (see FIGS. 2 and 4) that engage a rib stop block SBR1 of respective first and second ribs FR1 to position the ribs FR1 properly when they are mated with the male portion A. Likewise, the male coupler portion comprises a second pair of stop blocks SB2*a*,SB2*b* (see also FIGS. 2 and 4) that engage a rib stop block SBR2 of respective first and second ribs FR2 to position the ribs FR2 properly when they are mated with the male coupler portion A.

The invention has been described with reference to preferred embodiments. Modifications and alterations will occur to those of ordinary skill in the art to which the invention pertains upon reading this specification. It is intended that the claims be construed as broadly as possible, literally and/or according to the doctrine of equivalents.

The invention claimed is:

1. A male coupler portion adapted to mate with at least two different types of associated female coupler portions, said male coupler portion comprising:

a frame comprising: (i) first and second arm pin-on locations adapted for connection to associated first and second arms, respectively; (ii) at least one tilt member pin-on location adapted for connection to an associated tilt member; (iii) first and second coupler halves each comprising:

a first hook-engaging mount defined by a first member that is fixedly secured to and extends between first and second vertical ribs, said first hook-engaging mount adapted to be received into a hook of a female rib of a first type of associated female coupler portion;

a first rib locking location comprising a first locking channel defined between said first and second vertical ribs so as to be vertically aligned with said first hook-engaging mount;

a second hook-engaging mount defined by a second member that is fixedly secured to extends between said second vertical rib and a third vertical rib, said second hook-engaging mount adapted to be received into a hook of a female rib of a second type of associated female coupler portion that is different from the first type of associated female coupler portion;

a second rib locking location comprising a second locking channel defined between said second and third vertical ribs so as to be vertically aligned with said second hook-engaging mount; and, a plunger pin slidably connected to the frame and movable between an extended position and a retracted position, said plunger pin, when extended, adapted to engage and retain an associated female coupler portion rib ear located in either one of said first and second rib locking channels.

2. The male coupler portion as set forth in claim 1, wherein said first rib locking location of each coupler half comprises first and second lock apertures defined respectively in said first and second ribs and aligned with each other, and wherein said second rib locking location of each coupler half comprises said second lock aperture and a third lock aperture defined in said third rib and aligned with said second lock aperture, wherein said first, second and third lock apertures of each coupler half are aligned with each other and accommodate sliding movement of said plunger pin from said retracted position to said extended position, wherein said plunger pin, when in said extended position, extends through each of said first, second and third lock apertures to engage an associated ear of a female rib of a first type of associated coupler portion located in said first locking channel or an associated ear of a female rib of a second type of associate coupler portion located in said second locking channel.

3. The male coupler portion as set forth in claim 2, wherein said frame further comprises a face plate that extends between said first and second coupler halves, and wherein, for each of said first and second halves of said coupler, said face plate defines first and second openings that open respectively into said first and second rib locking channels, wherein said first opening of each coupler half is adapted to receive an ear of a female rib of the first type of associated female coupler portion, and wherein said second opening of each coupler half is adapted to receive an ear of a female rib of the second type of associated female coupler portion.

4. The male coupler portion as set forth in claim 2, further comprising:

a first hydraulic actuator operatively connected to said plunger pin of said first coupler half for moving said plunger pin of said first coupler half between said extended and retracted positions; and, a second hydraulic actuator operatively connected to said plunger pin of said second coupler half for moving said plunger pin of said second coupler half between said extended and retracted positions.

5. The male coupler portion as set forth in claim 2, wherein said first, second and third lock apertures and said plunger pin of each half of said coupler are cylindrical, and wherein said respective first and second members of said first and second hook-engaging mounts each comprise a cylindrical surface.

6. A male coupler portion comprising:

a frame comprising: (i) first and second arm pin-on locations adapted for connection to associated first and second arms, respectively; and, (ii) at least one tilt member pin-on location adapted for connection to an associated tilt member;

four separate hook-engaging mounts, wherein: (i) first and second ones of said hook-engaging mounts are symmetrically located on opposite sides of a centerline of said frame relative to each other and are adapted to be inserted into respective female rib hooks of a first type of associated female coupler; and, (ii) third and fourth ones of said hook-engaging mounts are symmetrically located on opposite sides of said centerline relative to each other and are adapted to be inserted into respective female rib hooks of a second type of associated female coupler;

four rib locking locations respectively vertically aligned with said four hook-engaging mounts, wherein: (i) first and second ones of said rib locking locations are symmetrically located on opposite sides of a centerline of said frame relative to each other and are adapted to receive respective female rib ears of the first type of associated female coupler; and, (ii) third and fourth ones of said rib locking locations are symmetrically located on opposite sides of said centerline relative to each other and are adapted to receive respective female rib ears of the second type of associated female coupler;

a first plunger pin for selective extension into both said first and third rib locking locations to engage an associate female rib ear located in one of said first and third rib locking locations;

a second plunger pin for selective extension into both said second and fourth rib locking locations to engage an associate female rib ear located in one of said second and fourth rib locking locations.

* * * * *